United States Patent [19]

Sheaves

[11] Patent Number: 4,580,940

[45] Date of Patent: Apr. 8, 1986

[54] REFUSE CONTAINER LIFT/DUMP APPARATUS

[75] Inventor: James R. Sheaves, Sanford, N.C.

[73] Assignee: American Refuse Systems, Inc., Roanoke Rapids, N.C.

[21] Appl. No.: 641,035

[22] Filed: Aug. 15, 1984

[51] Int. Cl.[4] ..... B65F 3/02

[52] U.S. Cl. ..... 414/406; 414/421

[58] Field of Search ..... 414/303, 406, 408, 420, 414/421, 425

[56] References Cited

U.S. PATENT DOCUMENTS

| | | | |
|---|---|---|---|
| 2,926,803 | 3/1960 | Collins | 414/420 |
| 3,804,277 | 4/1974 | Brown et al. | 414/406 X |
| 3,894,642 | 7/1975 | Shive | 414/421 X |
| 4,042,137 | 8/1977 | Hughes et al. | 414/421 X |
| 4,305,693 | 12/1981 | Naab | 414/408 X |
| 4,365,922 | 12/1982 | Borders | 414/406 |
| 4,422,814 | 12/1983 | Borders | 414/303 |
| 4,479,751 | 10/1984 | Wyman et al. | 414/406 |

FOREIGN PATENT DOCUMENTS

| | | | |
|---|---|---|---|
| 147210 | 10/1954 | Sweden | 414/406 |

*Primary Examiner*—Leslie J. Paperner
*Assistant Examiner*—David A. Bucci
*Attorney, Agent, or Firm*—B. B. Olive

[57] ABSTRACT

A dumping mechanism for lifting, rotating and dumping a waste receptacle of the type having a pair of vertically-spaced upper and lower support bars embodies an upwardly-rotatable face plate having an upper hook for engaging the upper bar of the waste receptacle, a latch member slidably mounted on the rear of the face plate with a lower hook for engaging the lower bar of the waste receptacle, a lever arm linked to the latch member and having one end pivotally mounted on the back of the face plate and an opposite end with a roller for engaging a fixed cam, a hydraulic motor supported between side plates appended to and extending rearwardly from the face plate and arranged for rotating the side plates and in turn the face plate about the motor shaft axis and means for energizing the hydraulic motor such that the face plate can lift, rotate and dump the container and then return the dumped container to a ground position with the lower hook engaging the receptacle during the dumping operation and disengaging the lower bar when in the ground position.

2 Claims, 9 Drawing Figures

REFUSE CONTAINER LIFT/DUMP APPARATUS

DESCRIPTION

1. Technical Field

The invention relates to apparatus attached to a municipal refuse vehicle for rotating and dumping a refuse container into the vehicle.

2. Background Art

U.S. Pat. Nos. 3,804,277; 3,894,642 and 4,042,137 exemplify the prior art. These patents are alike in teaching apparatus attached to a refuse vehicle for rotating and dumping a refuse container into the vehicle. The container employed has a pair of vertically-spaced, horizontal locking bars with the upper bar fitting into a fixed upper hook on a platform which rotates and with the lower bar being locked by a retractable lower hook during the rotating and dumping operation and released after completion of the operation. All of the mentioned prior art patents use a motor drive to rotate the container with U.S. Pat. No. 4,042,137 specifically referring to a hydraulic drive motor. U.S. Pat. Nos. 3,804,277 and 3,894,642 both teach use of cam actuators for locking the lower bar during container rotation and U.S. Pat. No. 4,042,137 teaches use of a cam controlled hydraulic piston locking arrangement.

With the advent of time and experience, there has arisen a need to further simplify and improve the rotating and dumping apparatus to facilitate ease of replacement for repair and maintenance, to provide even greater reliability of operation and to improve the lower bar locking arrangement. Such becomes the general object of the invention.

DISCLOSURE OF INVENTION

A portable household refuse container of the type adapted to the invention apparatus embodies a pair of vertically-spaced, horizontal locking bars on one side of the container. The dumping apparatus of the invention embodies a bi-directional hydraulic motor to rotate a container mounting platform about the motor axis. The upper container bar engages a fixed support hook on the platform and the lower bar is engaged and locked by a cam-actuated, spring-loaded hook on a sliding latch as the platform rotates. The latch releases after the container is dumped and the platform returns to its starting position.

BEST MODE FOR CARRYING OUT THE INVENTION

Figures 5, 6, 7, 8, 9:
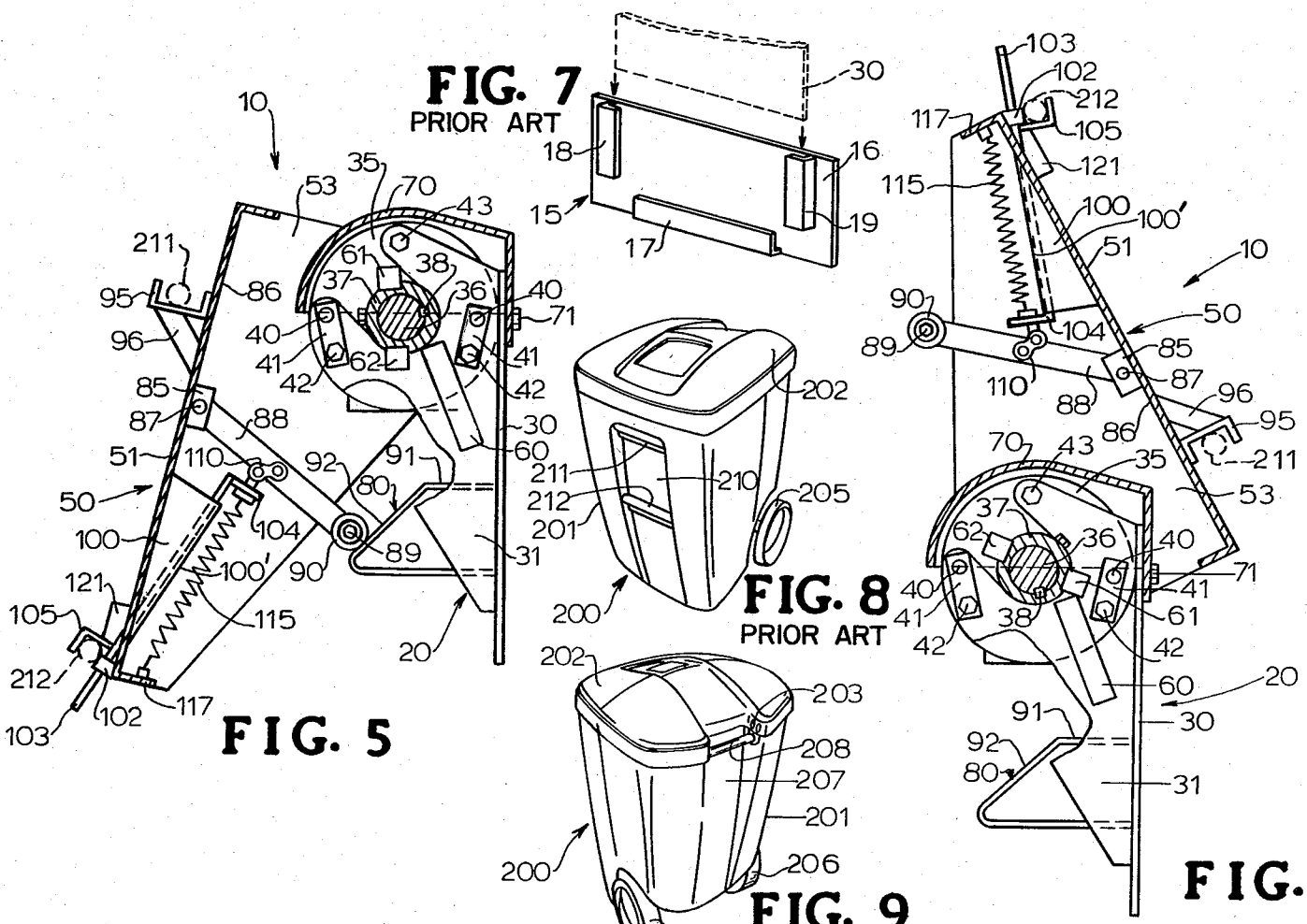
FIG. 7 PRIOR ART
FIG. 8 PRIOR ART
FIG. 9 PRIOR ART
FIG. 5 is a view similar to that of FIG. 4 but with the reversible hydraulic motor energized so that the apparatus is in an engaging partial lift position.
FIG. 6 is a view similar to that of FIGS. 4 and 5 but with the apparatus illustrated in an engaging relationship and with the lift plate and refuse container rotated into a substantially vertical dump relationship prior to rotation to the start position.
FIG. 7 is a fragmentary pictorial view illustrating how the municipal refuse collection system of the present invention is removably mounted on the rear of a conventional garbage truck.
FIG. 8 is a reduced front perspective view of the type refuse container employed in the invention refuse collection system and known in the prior art.
FIG. 9 is a rear perspective view of the refuse container of FIG. 8.

Illustrated in FIGS. 8 and 9 is a conventional household refuse container 200 of the type employed with the invention municipal refuse collection system. This type container is already in widespread use. Container 200 is preferably molded from plastic and has a capacity of approximately 80 gallons. Container 200 includes a receptacle portion 201 and a top 202 which is hingedly secured to the receptacle portion by hinges 203 located at the rear of container 200. A pair of wheels 205, 206 support container 200. A rear, centrally-located, vertical recess 207 includes a handle 208 which the operator may use for rolling container 200 from one site to another. The front of container 200 also includes a centrally-located vertical recess 210 in which is mounted a pair of vertically-spaced, horizontal upper and lower locking bars 211, 212 adapted to being engaged by the dumping mechanism of the invention.

Referring initially to FIG. 7, the dumping mechanism 10 of the invention is removably mounted on the rear of a conventional garbage truck adjacent the refuse receiving opening. Fixedly secured to the truck body is a vertical support frame 15 which slidably mounts support plate 30 forming part of base assembly 20. Frame 15 is comprised of a plate 16 welded, bolted or otherwise secured to the wall of the garbage truck below and adjacent the refuse-receiving opening of the truck. A bottom angle guide mount 17 and a pair of side-angled guide mounts 18, 19 slidably receive back plate 30 thereby providing support for base assembly 20 and facilitating removal for repair and replacement. A support arrangement similar to frame 15 for slidably receiving a support plate such as support plate 30 has, per se, been known and is not claimed here as part of the invention except in combination with other novel structure hereafter described.

Referring now more specifically to FIGS. 1–6, right frame member 31 and left frame member 32, formed of metal plate are fixedly secured at predetermined laterally-spaced locations to back plate 30. Frame members 31, 32 and back plate 30 comprise what has been referred to as base assembly 20. Hydraulic motor 35 mounts between frame members 31 and 32. Motor 35 is precisely located on members 31 and 32 by means of locator pins 40 which are integrally secured to spacers 41 forming locator assemblies. Pins 40 align with holes in motor 35 and, once so aligned, bolts 42 secure motor 35 and members 31 and 32 together. Bolts 43 further aid in securement.

Figure 1:
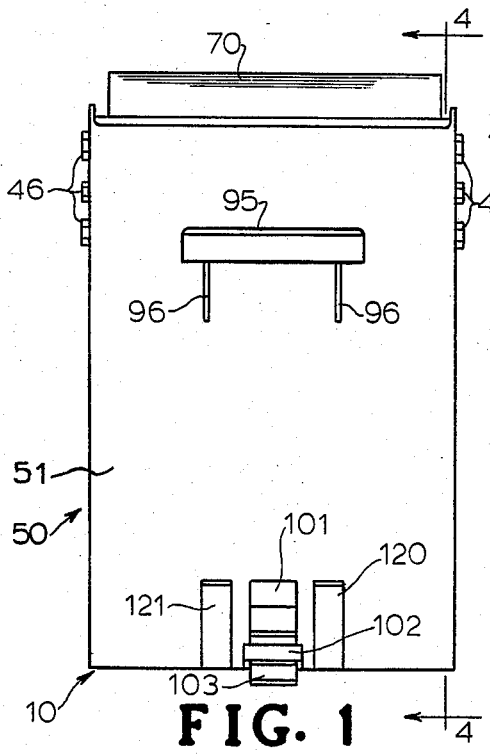
FIG. 1 is a front elevation view of the apparatus of the municipal refuse collection system of the present invention with the apparatus illustrated in the non-engaging/non-lift position.
Figure 2:
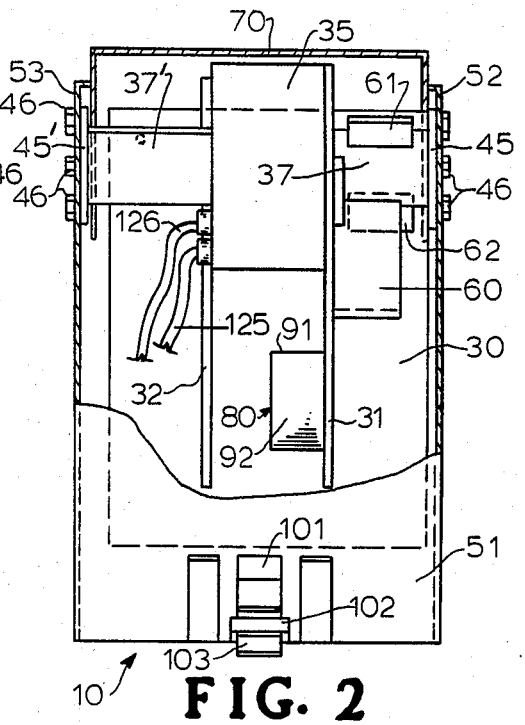
FIG. 2 is a fragmentary front elevation view of the apparatus of FIG. 1 with a portion of the main front plate of the lift platform cut away for purposes of illustration.
Figure 3:
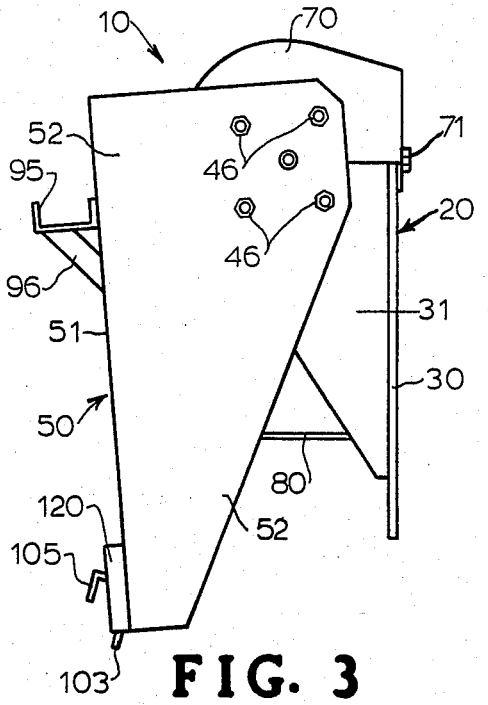
FIG. 3 is a side elevation view of the apparatus of the municipal refuse collection system of the present invention with the apparatus illustrated in the non-engaging/-non-lift position.
Figure 4:
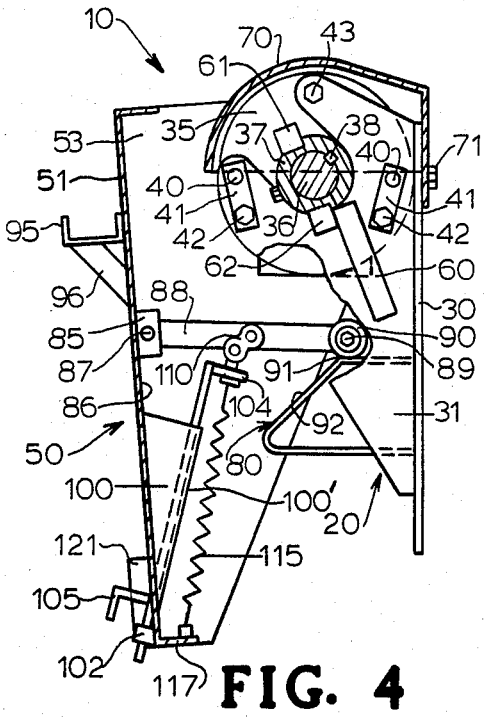
FIG. 4 is a section view taken substantially along line 4—4 of FIG. 1 and with a portion of the right frame cut away for purposes of illustration.

Motor 35 drives shaft 36 which extends outwardly from both sides of motor 35 and in turn drives a pair of sleeves 37, 37' which are keyed by keys 38 to shaft 36 as seen in FIGS. 4, 5 and 6. Fixedly secured to the outer opposed ends of sleeves 37, 37′ are plates 45, 45′ as seen in FIG. 2. Rotating platform 50 comprises face plate 51 and integral plate-formed side members 52, 53. Side members 52, 53 are secured to plates 45, 45′ by bolts 46 which pass through side members 52, 53 and screw into plates 45 thus allowing for rotation of platform 50 with sleeves 37, 37′ about the axis of motor shaft 36. Thus, platform 50 may rotate about the motor axis from the container loading position as in FIG. 4, to the ground clearing position of FIG. 5 and to the container dumping position illustrated in FIG. 6 when hydraulic motor 35 is suitably energized to drive shaft 36 in the appropriate dumping direction.

A stop block 60 is fixedly secured to the outer surface of right frame member 31 in a predetermined location. Further, a pair of limit blocks 61, 62 are fixedly secured at predetermined locations on sleeve 37. Forward or clockwise rotation as viewed in FIG. 4 of sleeve 37 causes block 61 to also rotate in a clockwise direction until block 61 contacts stop block 60 thus preventing further forward rotation as in FIG. 6. Reverse or counterclockwise rotation of sleeve 37 as viewed in FIG. 4 causes block 62 to rotate in a counterclockwise direction until it contacts stop block 60 thus preventing further reverse rotation as in FIG. 4. The forward rotation of sleeve 37 and block 61 thus causes the container platform, i.e., front plate 51, on which container 200 is mounted to initially rotate to the FIG. 5 lift position and then to the FIG. 6 dump position. Reverse rotation of sleeve 37 and block 62 will, of course, cause the front plate 51 of the platform assembly 50 to return to the position shown in FIGS. 1 and 3.

A cover 70 is fixedly secured by bolts 71 to back plate 30 and serves as a cover for motor 35 and other internal parts of the dumping mechanism 10. Loose garbage is thus prevented from getting into the motor area.

A cam 80 formed of a bent metal strip is integrally secured, preferably by welding, to the inside wall of right frame member 31. Bracket 85 is integrally secured to the inside wall surface 86 of front plate 51. Pivotally secured to bracket 85 by pin 87 is lift arm 88. Rotatably mounted by pin 89 to the free end of arm 88 is a friction-reducing roller or cam follower 90. With platform 50 in a lowered FIG. 4 position, roller 90 rests on the flat top surface 91 of cam 80. As best illustrated in FIG. 5, it will be seen that as motor 35 drives shaft 36 in the clockwise direction as viewed in FIG. 5, the container supporting platform face plate 51 will be rotated upwardly allowing the roller 90 to ride down the cam surface 92 until it reaches the nonengaging position of FIG. 6.

An upper hook or saddle 95 receives the upper container bar 211, shown in dashed lines in FIG. 5, and a lower hook 105 engages the lower container bar 212, also shown in dashed lines in FIG. 5, in a manner later explained. Upper hook 95 is secured by welding at a predetermined location to the front surface of plate 51 and is reinforced by gussets 96 welded to the base of hook 95 and also to the front surface of plate 51. Alternatively, upper hook 95 may be bolted in place and adjustable positions provided to accommodate to different container bar spacings.

A latch housing 100 is fixedly secured to the back surface of plate 51 and has a back wall 100′ angled inwardly as seen in FIG. 4. An opening 101 is formed in the lower portion of the front plate 51. A small U-shaped bracket 102 is integrally secured to the lower front surface of front plate 51 and is positioned across the lower end of opening 101. Bracket 102 slidably receives the lower end of an elongated latch 103. Latch 103 extends upwardly through opening 101 and is guided by the inside surface of back wall portion 100′ of latch housing 100. An integral inwardly turned bracket 104 is formed at the upper end of latch 103. Positioned upwardly a predetermined distance from the lower end of latch 103 there is integrally secured the previously-mentioned, outwardly-and downwardly-turned, lower hook 105.

The top surface of bracket 104, as seen in FIG. 4, has one end of a chain link 110 pivotally secured thereto. The opposite end of chain link 110 is pivotally secured at a position approximately midway the length of the lift arm 88. It will thus be apparent that as latch 103 moves up or down, arm 88 rotates correspondingly. A pair of springs 115, only one of which is illustrated, are secured beneath the pivotal connection of link 110 on bracket 104. Springs 115 extend downwardly from the bottom of bracket 104 and connect to the inwardly-turned ledge 117 of front plate 51. A pair of spacers or stand-offs 120, 121 are integrally mounted on the lower front surface of plate 51 and are spaced laterally on opposite sides of latch 103 so as to not impair its operation. Stand-offs 120, 121 assist in properly positioning container 200.

During operation of the refuse container dumping mechanism 10 of the invention, and with initial reference to FIG. 4, a trash container 200 is moved adjacent the lift mechanism 10 which is assumed to be detachably mounted adjacent the rear of the conventional trash truck as previously explained. The upper locking bar 211 of container 200 is placed into the upper hook 95 and the lower locking bar 212 assumes a position below the lower hook 105, but is initially disengaged therefrom. Prior to energization of hydraulic motor 35, which is powered off the hydraulic system of the garbage truck through hydraulic supply and return lines 125, 126, roller 90 rests on the flat top surface 91 of cam 80. Limit block 62 resides in contact with stop block 60 as seen in FIG. 4. Springs 115 pull downward on lift arm 88 and thus tend to pull latch 103 downward as illustrated in the start position of FIGS. 3 and 4. The lift mechanism through a suitable valve control, not shown, is operated such that appropriate line 125 or 126 serves as a supply line and the other line serves as a return line for the desired direction of rotation. Motor 35 is thus appropriately energized to cause the platform assembly 50 and its front plate member 51 on which the container 200 is assumed to be mounted to start rotating, see FIG. 5, towards the dump position of FIG. 6. Roller 90 will start moving downwardly on cam 80 as plate 51 rotates in a clockwise direction as best seen in FIG. 5. When wheels 205, 206 of container 200 are slightly off the ground, roller 90 will no longer be in contact with cam 80. At this stage, springs 115, 116 operate to pull latch 103 downwardly which causes the lower hook 105 to move into firm and positive engagement with the lower locking bar 212 of container 200 thereby locking the container 200 to the now upwardly rotating platform assembly 50. Further, it should be noticed that such rotation cause the integral platform assembly 50 made up of front plate 51 and side plates 52, 53 to rotate about the axis of the hydraulic drive motor 35. Those skilled in the art will, it is believed, recognize such an arrangement as a substantial improvement over prior motor drive systems. With continuing reference to the drawings and particularly to FIG. 6, motor 35 will continue to rotate the front platform plate 51, on which container 200 is mounted, upward until limit block 61 comes into contact with stop block 60. At this point, container 200 is fully inverted and is in the dumping position shown in FIG. 6. A significant advantage here is that the hydraulic pressure can remain applied to the motor 35 without damage to the system while the refuse is actually being dumped.

After the dumping operation has been observed to have been completed, the operator operates the hydraulic valve control, not shown, so as to reverse the direction of hydraulic motor 35. That is, the particular line 125 or 126 which was the supply line now operates as a return line and the other line operates as a supply line for the return or counterclockwise rotation as viewed in FIG. 4. As the platform assembly 50 returns to the initial start position of FIG. 4, the lower hook 105 will be disengaged from the lower locking bar 212 by the action of roller 90 again riding on cam 80 so as to lift latch 103 against the tension of springs 115, 116. The upper locking bar 211 of container 200 may now be lifted from upper hook 95 and the empty container 200 may be rolled away from the garbage truck.

It should be noted that that lower hook 105 is designed to be in engagement with the lower bar 212 only when the wheels 205, 206 are lifted from the ground. This delayed engagement has the advantage of preventing excessive stress on the container which could result if lower hook 105 were to engage the lower bar 212 with the container wheels still on the ground. While the desireability of such delayed action has been previously recognized in previously referred to U.S. Pat. No. 3,894,642, it has not heretofore been provided in the simplified motor mount platform arrangement of the invention.

In summary, it can be seen that the dumping mechanism 10 of the present invention provides a system whereby the trash container supported on a simplified motor-platform assembly is enabled to be rotated about the drive motor axis during the dumping and return operations. Further, it will also be seen that the dumping mechanism of the invention enables the container to be positively locked and secured with simplified linkage and camming during the lifting operation but without damage or undue stress to the container.

What is claimed is:

1. A dumping mechanism for lifting, rotating and dumping a waste receptacle of the type having a pair of vertically-spaced upper and lower horizontal locking bars on one side thereof, comprising:

(a) a base assembly having a vertical support plate, said support plate having front and rear sides, upper and lower ends;

(b) support means adapted for mounting said support plate on a waste-collecting vehicle proximate an opening into which waste is to be dumped;

(c) a reversible hydraulic motor mounted on the front side of said support plate and having a horizontal driven shaft extending outwardly therefrom, said shaft having an axis parallel to the plane of the front side of said plate and spaced outwardly from the upper end thereof;

(c) an integral platform assembly having a front plate with front and back surfaces and with appended opposed parallel side plates extending rearwardly therefrom, upper and rearwardly disposed portions of said side plates positioned such that said shaft axis passes therethrough and being supported for rotation by said shaft about said axis;

(e) an upper hook mounted on said front plate for receiving the upper bar of a waste receptable, (f) an elongated latch member with upper and lower ends and having a lower portion extending through a centrally-positioned opening formed in a lower portion of said front plate, a lower hook mounted on said latch member and extending outwardly from said front plate opening and adapted to engage the lower bar of a waste receptacle, said latch member being slidably mounted on structure secured to the back surface of said front plate;

(g) an elongated lever arm having one end pivotally mounted on the back surface of said front plate and having an opposite end with a low friction cam engaging means mounted thereon forming a lever arm cam engaging means;

(h) connector means providing a link between an intermediate pivotal connection on said lever arm and a pivotal connection on the upper ned of said latch member;

(i) spring tensioning means mounted on and moveable with said platform assembly for urging said latch member and lever arm in a direction for locking said lower container bar with said lower hook;

(j) a cam fixed to the front surface of said support plate and having a cam surface for engaging said lever arm cam engaging means when said front plate is in towards a container loading position and for being disengaged therefrom when said front plate assumes a container dumping position; and (k) wherein when said motor is energized for rotating said front plate upwardly to a dumping position with a container engaged by its said upper bar in said upper hook, said container is lifted and rotated to said dumping position and during said rotation said lever arm cam engaging means is caused to ride on said cam surface and to be disengaged therefrom and said latch member is caused after said container is lifted from its ground position to move said lower hook into resilient engagement with the lower part of said container and when said motor is energized to rotate said front plate in the opposite direction to return said container to its ground position said lever arm cam engaging means again strikes said cam surface and disengages said lower hook from said container lower bar enabling said container upper bar to be removed from said upper hook.

2. A dumping mechanism as claimed in claim 1 wherein said shaft includes portions thereof extending from both sides of said motor, a sleeve mounted on and driven by each portion of said shaft, means securing each of said respective sleeves to a respective said side plate thereby providing support for said front plate from said motor shaft, positive stop means operatively associated with at least one of said sleeves to limit the direction of rotation of said motor shaft in both directions of movement and wherein said cam engaging means comprises a roller.

* * * * *

UNITED STATES PATENT OFFICE

CERTIFICATE OF CORRECTION

Patent No. 4,580,940 Dated April 8, 1986

Inventor(~~s~~) James R. Sheaves

It is certified that error appears in the above-identified patent and that said Letters Patent are hereby corrected as shown below:

Column 6, line 23, "ned" should be corrected to read --end--.

Signed and Sealed this

*Twenty-ninth* Day of *July 1986*

[SEAL]

*Attest:*

DONALD J. QUIGG

*Attesting Officer*

*Commissioner of Patents and Trademarks*